United States Patent [19]

Burkland

[11] 4,301,630

[45] Nov. 24, 1981

[54] METHOD AND APPARATUS FOR LIFT-SLAB BUILDING CONSTRUCTION

[76] Inventor: Raymond A. Burkland, Cove Run Farm, P.O. Box 9A, Lemont Furnace, Pa. 15456

[21] Appl. No.: 64,868

[22] Filed: Aug. 8, 1979

[51] Int. Cl.[3] ..... E04B 1/35

[52] U.S. Cl. ..... 52/126; 52/236.3; 52/745; 254/89 H

[58] Field of Search ..... 52/126, 745, 234, 236.3, 52/236.9, 749; 214/1 H, 1 S; 254/89 R, 89 H; 264/33

[56] References Cited

U.S. PATENT DOCUMENTS

| | | | |
|---|---|---|---|
| 3,028,144 | 4/1962 | Cheskim | 52/126 X |
| 3,065,573 | 11/1962 | Goldberg | 52/126 |
| 3,179,374 | 4/1965 | Wälli | 52/126 X |
| 3,363,393 | 1/1968 | Von Heidenstam | 52/126 X |
| 3,552,080 | 1/1971 | Gretchenliev et al. | 52/745 |
| 3,579,935 | 5/1971 | Regan et al. | 52/126 |
| 3,594,965 | 7/1971 | Saether | 52/126 |
| 3,828,513 | 8/1974 | Vanderklaauw | 52/745 |

FOREIGN PATENT DOCUMENTS

| | | | |
|---|---|---|---|
| 1300143 | 6/1962 | France | 52/126 |

*Primary Examiner*—J. Karl Bell

*Attorney, Agent, or Firm*—Cushman, Darby & Cushman

[57] ABSTRACT

Pre-formed concrete floor slabs stacked one on top of the other, at or near ground level, are raised vertically into desired elevations for permanent attachment to the building structural columns. The same cylindrical forms used to pour each floor's height of the building's columns are also utilized as hydraulic cylinders to lift the forms, and connected floor slabs, upon the previously hardened column sections to the next higher floor level where the process is repeated until the entire building structure of columns and floors is in place.

14 Claims, 6 Drawing Figures

METHOD AND APPARATUS FOR LIFT-SLAB BUILDING CONSTRUCTION

BACKGROUND OF THE INVENTION

Most current lift-slab methods utilize a variety of lifting devices, usually placed on top of pre-elevated columns, which are based on some variation of block and tackle leverage, or short stroke hydraulic jacking, to lift pre-formed floor slabs for attachment to these same pre-elevated columns. These processes generally require about one week's erection time per floor.

SUMMARY OF THE INVENTION

Pre-formed concrete floor slabs stacked one on top of the other, at or near ground level, are raised vertically into desired elevations for permanent attachment to the building structural columns. The same cylindrical forms used to pour each floor's height of the building's columns are also utilized as hydraulic cylinders to lift the forms, and connected floor slabs, upon the previously hardened column sections to the next higher floor level where the process is repeated until the entire building structure of columns and floors is in place.

When using the method and apparatus of the present invention, the same tubular column-forming apparatus used to mold the concrete column floor by floor also serves as a hydraulic lifting device. There are preferably provided additional features which, when operating in conjunction with the column-forming apparatus, provide for the following: insertion of column re-bars and ratchets; pouring of concrete; steam curing of concrete; control of the rate of hydraulic injection and consequently of the raising of the form and slabs; and, for the permanent connection of floor slabs to the columns.

Thus, by employing the method and apparatus of this invention, a construction crew can erect a one story complement of concrete columns, including the raising and anchoring of a floor slab thereto, per working day. This rapid erection procedure results in saving time and lessening man-hour requirements, thereby substantially increasing construction productivity.

The principles of the invention will be further discussed with reference to the drawings wherein a preferred embodiment is shown. The specifics illustrated in the drawings are intended to exemplify, rather than limit, aspects of the invention as defined in the claims.

DETAILED DESCRIPTION OF A PRESENTLY PREFERRED EMBODIMENT OF THE INVENTION

In general, the method of construction of a building utilizing the apparatus described herein consists of starting with conventionally prepared footings and reinforced floor slabs at or near ground level; and thereupon, applying the techniques more fully described hereinbelow with reference to the drawings.

Figure 1:
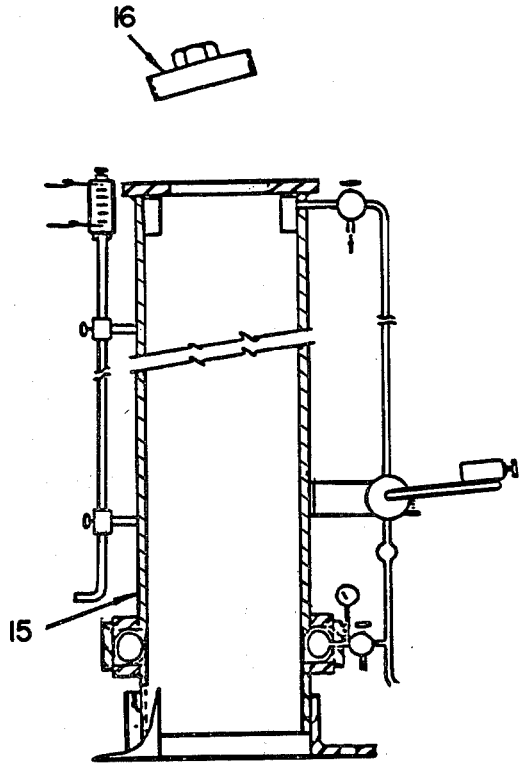
FIG. 1 is a longitudinal vertical sectional view of the starter column, with ratchets and rebar, in place on the base.
Figure 1:
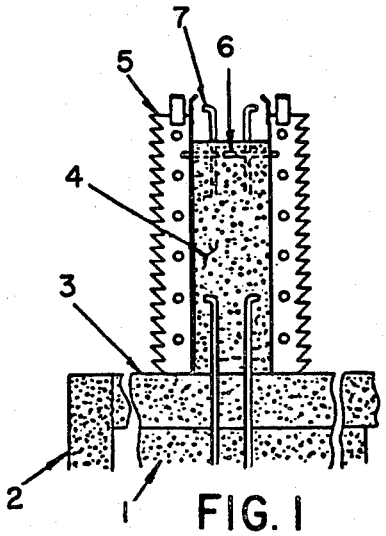

At the stage depicted in FIG. 1, concrete standard footings 1, base walls 2 and ground slab 3 all have been conventionally poured and set or otherwise conventionally constructed. In this Figure, one starting, or stub column 4 has been conventionally poured and secured on the ground slab. (Usually several of these will be provided on the ground slab at spaced sites, but for simplicity only one is shown in FIGS. 1–5 and the discussion relating thereto should be considered illustrative of the situation respecting all of the columns.)

The starting column 4 is poured to a height somewhat greater than, e.g. $1\frac{1}{2}$ feet greater than the combined height of all the floor slabs required. This stub column has a plurality (two are shown, but three or more are preferred) angularly spaced, cast-in-place, vertically extending, outwardly exposed ratchet rack gear strips 5, each of which extends continuously along the entire height of the stub column. Also cast-in-place are respective ratchet spacers 6 and reinforcing rebars 7.

Figure 2:
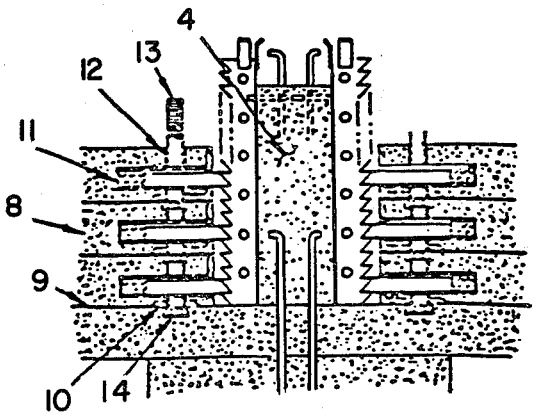
FIG. 2 is a longitudinal vertical sectional view of a later stage, with the stack of individual floor slabs, each with collars, dogs and lifting rods, in place on the starter column and the casting apparatus ready to be lowered over the stub column for mounting on the stack of floor slabs.

At the stage depicted in FIG. 2, the required number of floor slabs 8 have been poured in place on the ground slab around the starting column. As each is poured, it is separated from the one beneath it by providing a conventional non-binding, e.g. sprayed-on, top of slab coating 9 on the respective underlying slab. The slabs 8 are separated from the starting column 4 by an integrally cast-in-place lifting collar 10, e.g. made of steel. Also shown cast into the slabs 8 are individually boxed-in, spring-projected ratchet dogs 11, and openings 12 for insertion of lifting bolts 13 and removable nuts 14, or equivalent disengageable fasteners. The slabs 8 may be conventionally pre-stressed or post-tensioned to structurally strengthen them to withstand the lifting process and to bear the floor loading.

The tubular column casting form 15 is also shown by itself in FIG. 2, ready to be lifted over and onto the exposed stub of the starting column which protrudes above the stacked floor slabs, and brought to rest on the top floor slab. The uppermost lifting bolts 13 are attached to the bottom of the casting apparatus 15, thus connecting the casting apparatus to the stack of floor slabs. The tubular column form is now plumbed, if necessary, by inserting variable wedges under the bottom of the form and upon the top surface of the uppermost floor under the form. The removable top plug 16 is shown in a removed condition in FIG. 2. Various other parts of the column form apparatus are described below in relation to later stages.

Figure 3:
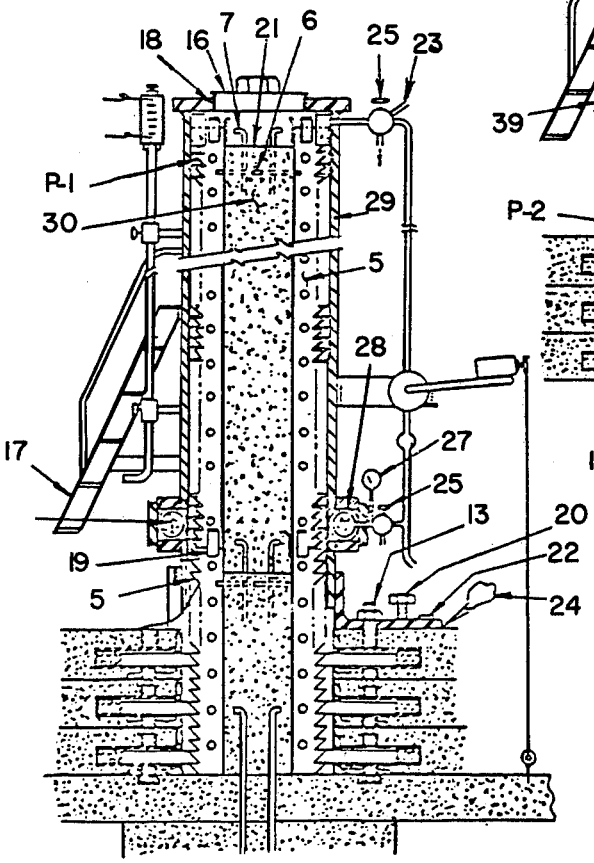
FIG. 3 is a longitudinal vertical sectional view of a later stage wherein the casting apparatus of FIG. 2 is in use and one increment of column has been cast.

FIG. 3 shows the column forming apparatus 15 in place on starting column 4. Ladder 17 is attached.

Vertical ratchets are now placed and braced inside the form as vertical extensions of the respective ratchets 5 set into the starting column. Ratchets 5 are covered by removable plastic P-1, and ratchet-spacers 6 are installed through the top cover hole 18, and are held in place by receiver-connectors 19 on top of previously cast-in ratchets 5. Adjustable shimming bolts 20 set form to vertical position. All fittings are connected to prime supplies from ground. Concrete is then poured through cover hole 18 to within, e.g. five inches of the top 21, and rebars 7 are installed.

The concrete is vibrated if required and before initial set, the plumb of the form is checked and adjusted, if necessary, using the attached bullseye level 22.

After initial concrete-set, the plug 16 is inserted and steam is injected through a pressure line 23 and is permitted to flow around the entire periphery of the column concrete to the bottom of the form and exit at 24. Upon sufficient curing, flow is cut-off using the 3-way valve 25.

To prevent release of pressure inside the form during lifting, the lower section of the form includes an integral radially expansible-contractile gasket, which is expanded by introducing sufficient pressure thereto, prior to lifting of the apparatus.

Inflating pressure is applied sufficiently to cause the inflatable toroidal seal 28 to press against the, e.g. neoprene liner 29 to effectuate an adequate resistance against the concrete column 30 to contain hydraulic fluid 31 that is introduced in the annulus via valve 25. Pressure is monitored using the gauge 27.

The tubular form now acts as a cylinder, upon the hardened concrete column, acting as a piston, to raise the apparatus, with its attached floor slabs, to the proper floor height for the first lift slab floor. At this level the lowest floor slab 8A is unbolted from the supporting lift rods 13, and remains connected and supported by the cast-in dogs 11 to the cast-in ratchet bars 5 of the column.

In addition, the cover P-1 over the ratchet teeth is removed during lifting, by attachment of pointed vertical cutting plates at the bottom of the form, positioned so that, as the form moves upward upon the column, the ratchet cover P-1 is peeled-off and stripped from the ratchet faces, thus providing a clearer area for the floor slab dogs to enter, during and after the lifting phase, and thereby providing a mechanical connection to the column which prevents retrogression.

The rate of lift is controlled by connecting the tubular column form's hydraulic inlet valve to a time-released wire line attached through an opening in the floor slabs to a point on a ground floor slab.

This time-controlled lifting rate allows hydraulic pressure to adjust to the load demand and permits the floor slabs to be raised simultaneously on the same horizontal plane.

Figure 4:
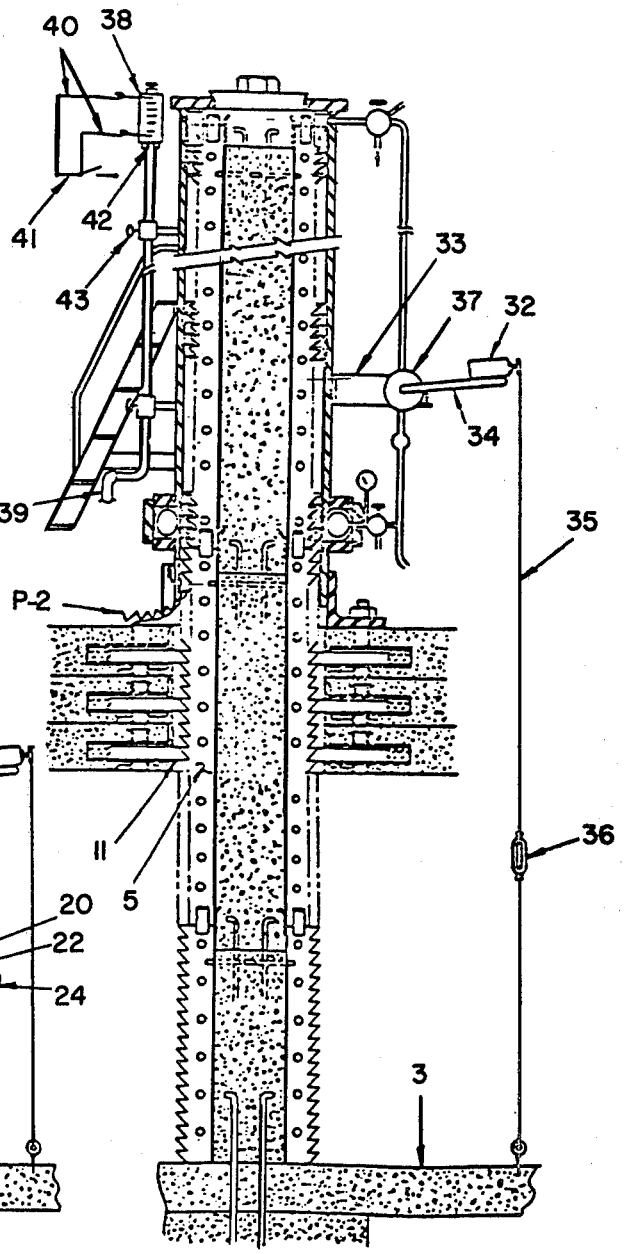
FIG. 4 is a longitudinal vertical sectional view of a later stage in which all of the floor slabs have been lifted from the base and two increments of column have been poured on the starter column.

An example of the foregoing is shown in FIG. 4. There, the ratchet-covering plastic is shown being stripped at P-2 and the timing apparatus for controlling the rate of rising of the form and slabs is shown including a rotatable spool 32 attached to the form by a bracket 33 and by a lever arm 34. Wire, or cable 35 is attached to the ground slab at 3 and runs upward vertically to spool 32, with tension being adjusted by a turnbuckle 36. Tension on spool, via an electric motor control, actuates lever arm 34 which controls the flow of an hydraulic fluid into the form via valve 37. Thus actuated and controlled, the form and attached slabs rise at a predetermined rate. Attached to the form is a water level readable gauge 38, connected by a hose 39 to all the other forms being simultaneously used to form other columns. This attachment permits a visual reading as to the degree of the rise of the slabs. The readable gauge includes a screw-in transparent tube 38 containing an electrolyte and electrodes 40 connecting to an on-off, and up-down directional switch 41. Tube 38 contains a restriction 42 to prevent surging and dissipation of electrolyte. Tube 38 is vertically adjustable via wing nuts 43 on brackets, so that all the forms are interconnected as to level before lifting. It is contemplated that the electrolyte-levelling switching device may, as an overriding and superceding control replace the spooled-wire device shown. And, that this device may be employed to effectuate control of all pressures to the end that all slabs are raised simultaneously, within ½ inch of horizontal. A conventional laser transit may be employed to activate the controls necessary to achieve this.

After completion of each lifting cycle, hydraulic pressure is released, the top plug is removed, and the next floor's column-forming is commenced. The process is repeated until the building structure is complete, whereupon column forms and supply lines are removed.

Figure 5:
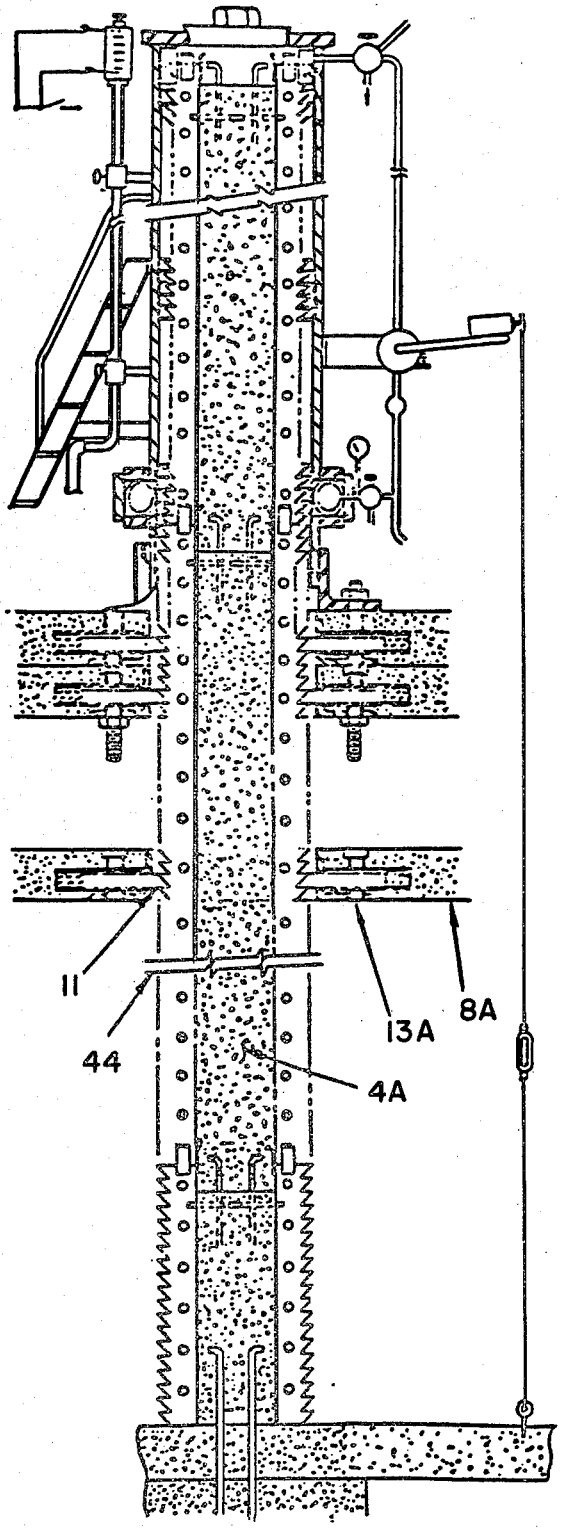
FIG. 5 is a longitudinal vertical sectional view of a later stage in which the lowermost floor slab has been detached from the lifting apparatus and attached to the column, the remaining floor slabs have been lifted further and further increment(s) of column have been poured.

At the stage depicted in FIG. 5, all the slabs 8 have been raised above ground floor 3. The bottom lift slab 8A is at first floor ceiling height, attached to the column 4A by locking dog 11. Lift rod nut 13A has been unscrewed from the lift rods 13 at the bottom of the slab. Thus, floor slab 8A is permanently secured in position on column via dogs and ratchets. Break lines 44 thru column show variable height.

Figure 6:
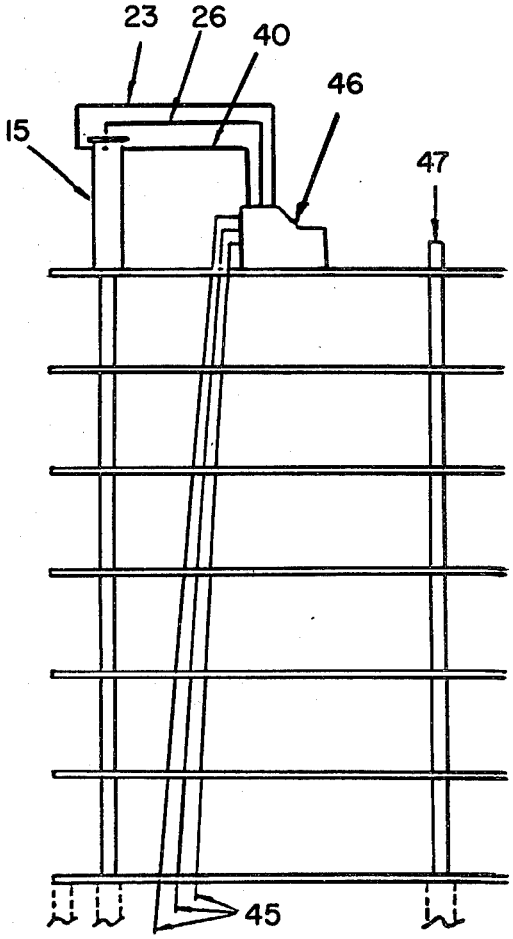
FIG. 6 is a schematic elevation view of a building skeleton built in accordance with principles of the present invention, showing a master control station for conducting the process mounted on the uppermost floor slab, which constitutes the roof slab.

FIG. 6 is a somewhat more schematic view showing unified control of the pouring of several columns of the building and simultaneous lifting of all of the floors. At the stage depicted, all pouring and lifting has been completed and the construction apparatus is being dismantled. Note that the uppermost lift slab has become the building roof. Now the ground supply lines 45 that have been hooked-up to a master station from which individual lines 23, 26 and 40 run to the individual column forms 15 are ready to be dismantled. Then the concrete caps 47 of the individual columns which protrude above the roof slab are sealed with conventional sealant.

It should now be apparent that the method and apparatus for lift-slab building construction as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. Apparatus for constructing a concrete building framework of a plurality of floors and at least one supporting column on a previously prepared ground slab that includes an upwardly projecting starting column for each supporting column, and a stack of at least two previously prepared releasably serially interconnected floor slabs supported on the ground slab and having said starting column projecting up through vertically registered holes through each said floor slab, said apparatus comprising:

a tubular, upright column form with a side wall having substantially the same transverse cross-sectional size and shape as the starting column so that the column form may be initially placed on the uppermost floor slab with the starting column projecting part way up into the column form;

said column form side wall having a lining of resilient material;

means releasably connecting the uppermost one of said floor slabs to said column form;

a removable plug for closing the upper end of the column form and for leaving the upper end of the column form open for when settable concrete is being introduced into the form to make an increment of columns;

a toroidal gasket means provided on said column form adjacent the lower end of said side wall, for forming a seal against such increment of the starting column or column being formed as lies radially adjacent said toroidal gasket means;

means for introducing pressurized hydraulic fluid into the column form annularly between the column being formed and said side wall lining, so that with said removable plug installed, the column form may be caused to hydraulically lift relative to the column being formed, thus also lifting the stack of floor slabs, so that as each floor's complement of column is formed, the then lowermost, lifted floor slab may be detached from the stack secured to the column and left behind as the column form is further lifted, until the uppermost floor slab is thereby fully lifted and connected to the thus-completed column.

2. The apparatus of claim 1, wherein:

said toroidal gasket means comprises a pressurized fluid-inflatable elastic gasket and means for introducing pressurizing fluid thereinto.

3. The apparatus of claim 1, further including:

means for introducing steam into the column form near the upper end thereof and for permitting the excess introduced steam to escape near the lower end of the column form for steam-curing settable concrete within the form.

4. The apparatus of claim 3, wherein:

the means for introducing steam and the means for introducing pressurized hydraulic fluid comprise respective supplies of steam and pressurized hydraulic fluid, a three-way valve communicated to both supplies and a common conduit leading from the three-way valve to the interior of the column form.

5. The apparatus of claim 1, wherein:

the floor slabs are to be connected to the column by ratchet dogs secured to the floor slabs and ratchet rack gears partially embedded in the exterior of the column being formed and the apparatus further includes means on the column form near the lower end thereof but located above where the stack of floor slabs is releasably secured to the column form, for stripping a previously placed covering from the outsides of the ratchet rack gears as the column form is raised.

6. The apparatus of claim 1, further comprising:

a plurality of such column forms; and means for coordinating introduction of pressurized fluid into all the column forms simultaneously to raise all the column forms and the stack of floor slabs releasably connected therewith.

7. The apparatus of claim 6, wherein:

the means for introducing pressurized fluid into the column form comprises a conduit means communicated to the interior of each column form and a separate valve for each such conduit means; and further comprising:

control means extending between the ground slab and each said valve for controlling the rate of upward movement of each column form, when pressurized fluid is being introduced into each column form for raising the column form, said control means including means for sensing local height above the lift slab and for relatively increasing and decreasing the amount of pressurized fluid being introduced into each column form in a sense to maintain the stack of floor slabs in a substantially horizontal condition as said column forms are being raised.

8. The apparatus of claim 7, wherein:

the control means includes for each column a wireline anchored to the ground slab and connected to the valve in a sense to operate the valve; and means for paying out all of said wirelines at a nominally constant rate as said column forms are being raised, so that any different tensions on the individual wirelines will tend to cause a compensating change in the introduction of pressurized fluid to the respective column forms, in order to lift the stack of floor slabs in a maintained substantially horizontal condition.

9. A method for constructing a building framework of concrete on a previously prepared ground slab, including:

(a) providing at least one upwardly projecting starting column on the ground slab;

(b) providing a stack of individual horizontally extending floor slabs upon the ground slab, each of the floor slabs having a hole vertically through it, these holes being aligned and the starting column projecting up through all of them to leave an exposed stub;

(c) temporarily connecting each floor slab to each of its vertically neighboring floor slabs;

(d) installing an open lower end tubular column form over the exposed stub, this column form having an internal side wall that is of substantially the same size and shape as the stub;

(e) temporarily connecting the column form to the uppermost said floor slab;

(f) introducing settable concrete into the column form and permitting the settable concrete to at least partially set;

(g) establishing an annular seal between the column being thus formed and the internal side wall of the column form adjacent the lower end of the column form;

(h) closing the upper end of the column form;

(i) introducing pressurized fluid into the annulus defined between the column being formed in the internal side wall of the column form with sufficient pressure as to cause said column form to raise relative to the column being formed in order to withdraw a substantial amount of the column being formed out of the lower end of the column form and to make space for forming more of the column within the column form;

when a full story increment of column has thus been formed, connecting the lowermost said floor slab to the column being formed and disconnecting that floor slab from the resulting remainder of the stack of floor slabs (j) repeating steps (f) through (i) in succession until all full story increments of the column thus have been formed, each floor slab has been connected to the column, and each floor slab except the uppermost one has been disconnected from the column form;

(k) disconnecting the column form from the uppermost floor slab.

10. The method of claim 9, wherein:

a plurality of such starting columns, and tubular column forms are provided, each starting column extending up through a respective set of vertically aligned holes through the stack of lift slabs and each column form surmounting a respective starting column stub and being temporarily connected to the uppermost said roof slab;

performing steps (f)-(j) coordinately for all the column forms; then performing step (k) as to each column form.

11. The method of claim 9, wherein:

step (g) comprises inflating a hollow toroidal seal between the column being formed and the column form.

12. The method of claim 9, further comprising:

introducing steam into the column in connection with step (f) for assisting in steam-curing the settable concrete that has been introduced into the column form.

13. The method of claim 9, further comprising:

providing a locking dog on each floor slab, which locking dog is resiliently projected in the vicinity of said hole through the respective floor slab;

partially embedding a plurality of angularly spaced vertically oriented, outwardly exposed ratchet rack gear strips in the column being formed, by mounting some of said strips in the column form prior to conducting step (f), and repeating this mounting step as to more of said strips before each next time step (f) is to be repeated;

exteriorly covering each ratchet rack gear strip mounted in the column form with a strippable plastic covering prior to conducting the respective step (f); and as increments of the column being formed emerge out of the lower end of the column form, stripping the plastic covering from said ratchet rack gear strips, in order to prepare the ratchet rack gear strips to connect with the respective lowermost floor slab by engagement of said locking dog of said lowermost lift slab in one of said ratchet rack gear strips.

14. The method of claim 10, further comprising:

sensing horizontally of the stack of floor slabs as step (i) is being performed and relatively increasing and decreasing rates of injection of pressurized fluid in response to sensation of local variation from horizontality in order to raise the stack of floor slabs in a more substantially horizontal condition.

* * * * *